US009853393B2

(12) United States Patent
Guo et al.

(10) Patent No.: US 9,853,393 B2
(45) Date of Patent: Dec. 26, 2017

(54) ELECTRICAL CONNECTOR WITH IMPROVED WATERPROOF PERFORMANCE

(71) Applicant: FOXCONN INTERCONNECT TECHNOLOGY LIMITED, Grand Cayman (KY)

(72) Inventors: Bin Guo, Kunshan (CN); Xiao-Bo Du, Kunshan (CN); Chun-Ming Yu, Kinshan (CN); Guo-Hua Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/588,705

(22) Filed: May 8, 2017

(65) Prior Publication Data

US 2017/0324188 A1 Nov. 9, 2017

(30) Foreign Application Priority Data

May 6, 2016 (CN) ..... 2016 2 0402890 U

(51) Int. Cl.
*H01R 9/05* (2006.01)
*H01R 13/52* (2006.01)
*H01R 13/405* (2006.01)

(52) U.S. Cl.
CPC ..... *H01R 13/5219* (2013.01); *H01R 13/405* (2013.01)

(58) Field of Classification Search
CPC ..... H01R 13/5202; H01R 13/5205
USPC ..... 439/589, 926, 587
See application file for complete search history.

(56) References Cited

U.S. PATENT DOCUMENTS 9,437,957 B2 * 9/2016 Lee ..... H01R 13/5202
9,608,359 B2 * 3/2017 Arai ..... H01R 12/716
9,634,425 B1 * 4/2017 Hsu ..... H01R 13/5202

FOREIGN PATENT DOCUMENTS

CN 203445352 U 2/2014
CN 204538371 U 8/2015

* cited by examiner

*Primary Examiner* — Phuong Dinh
(74) *Attorney, Agent, or Firm* — Wei Te Chung; Ming Chieh Chang

(57) ABSTRACT

An electrical connector comprises: an insulative housing and a plurality of terminals retained in the insulative housing. The insulative housing has a base portion and a mating tongue. The mating tongue comprises a stepped portion extending from the base portion and a tongue portion extending from the stepped portion. The insulative housing defines an outer periphery. The stepped portion defines a front face. The base portion defines a rear face. The terminal defines a connecting portion buried in the base portion and the stepped portion, a contacting portion extending from the connecting portion. The insulative housing defines a sealing member filling in the periphery of the connecting portion. The sealing member not extends out the front face of the stepped portion, the rear face of the base portion and the out periphery of the insulative housing. It is favorable for improving the waterproof effect of the electric connector.

7 Claims, 10 Drawing Sheets

ELECTRICAL CONNECTOR WITH IMPROVED WATERPROOF PERFORMANCE

BACKGROUND OF THE INVENTION

1. Field of the Invention

The present invention relates to a waterproof electrical connector.

2. Description of Related Arts

China Patent Issued No. CN204538371U, issued on Aug. 5, 2014, discloses an electrical connector including an insulative housing defining a base portion and a tongue portion extending forwardly from the base portion. The tongue portion defines opposite first and second surfaces. A plurality of first contacts are retained in the insulative housing and partially exposed on the first surface and a plurality of second contacts are retained in the insulative housing and partially exposed on the second surface. Due to presence of a gap between the terminals and the base portion, water may be penetrated into the electrical connector from the gap. This may cause short circuit or damage of the circuit board and can not meet the waterproof demand for electronic products.

An improved electrical connector having improved waterproof performance is desired.

SUMMARY OF THE INVENTION

An object of the present invention is to provide a waterproof electrical connector.

To achieve the above-mentioned object, an electrical connector comprises: an insulative housing and a plurality of terminals retained in the insulative housing. The insulative housing has a base portion and a mating tongue. The mating tongue comprises a stepped portion extending forwardly from the base portion along an insertion direction and a tongue portion extending forwardly from the stepped portion. The insulative housing defines an outer lateral. The stepped portion defines a front face. The base portion defines a rear face. Each of the terminals defines a connecting portion buried in the base portion and the stepped portion, a contacting portion extending forward from the connecting portion and a soldering tail extending out of the base portion. The contacting portion exposes to two surfaces of the tongue portion. The insulative housing further defines a sealing member filling in the periphery of the connecting portion. The sealing member not extends out of the front face of the stepped portion, the rear face of the base portion and the out lateral of the insulative housing. The utility model is favorable for improving the waterproof effect of the electric connector.

Other objects, advantages and novel features of the invention will become more apparent from the following detailed description when taken in conjunction with the accompanying drawings.

DETAILED DESCRIPTION OF THE PREFERRED EMBODIMENT

Figure 2:
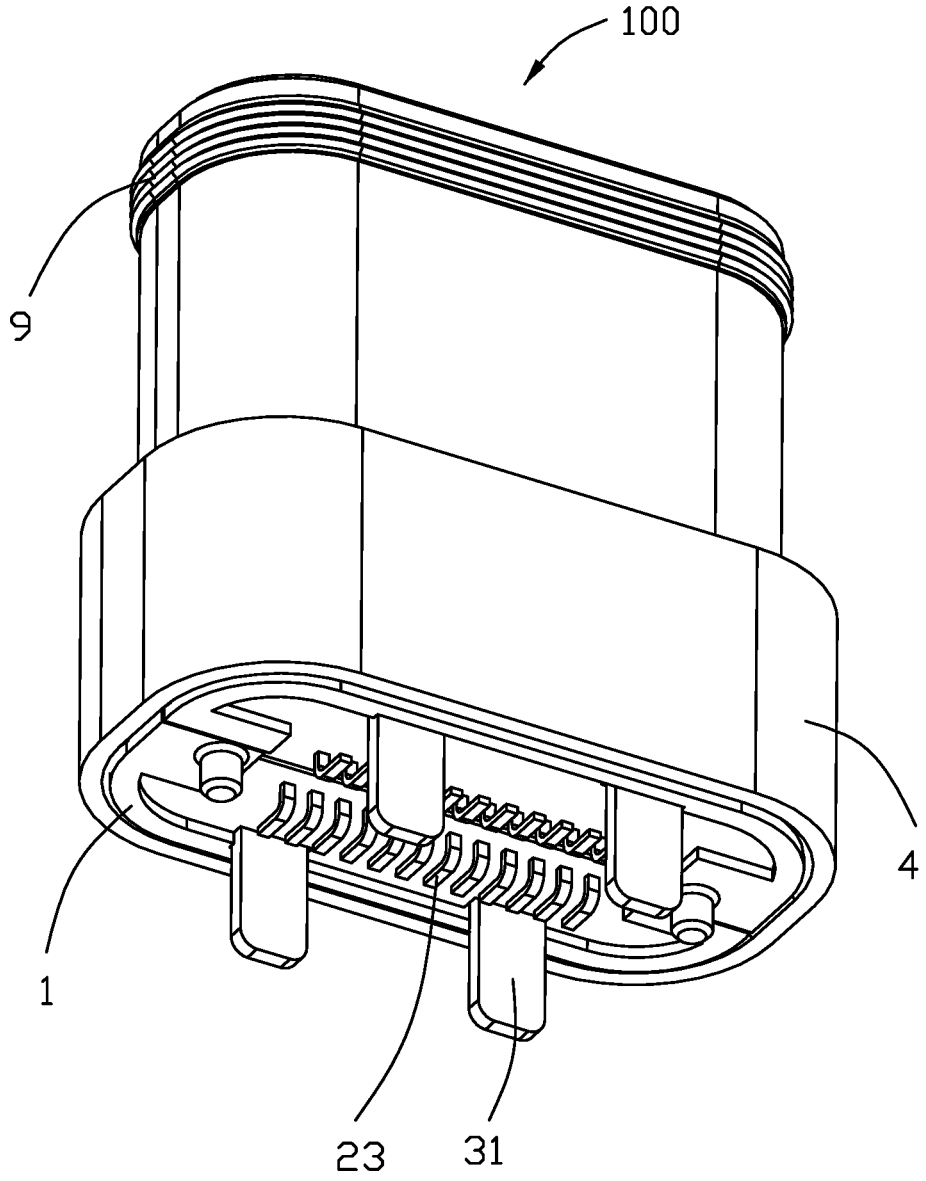
FIG. 2 is another perspective view of the connector in FIG. 1.
Figure 3:
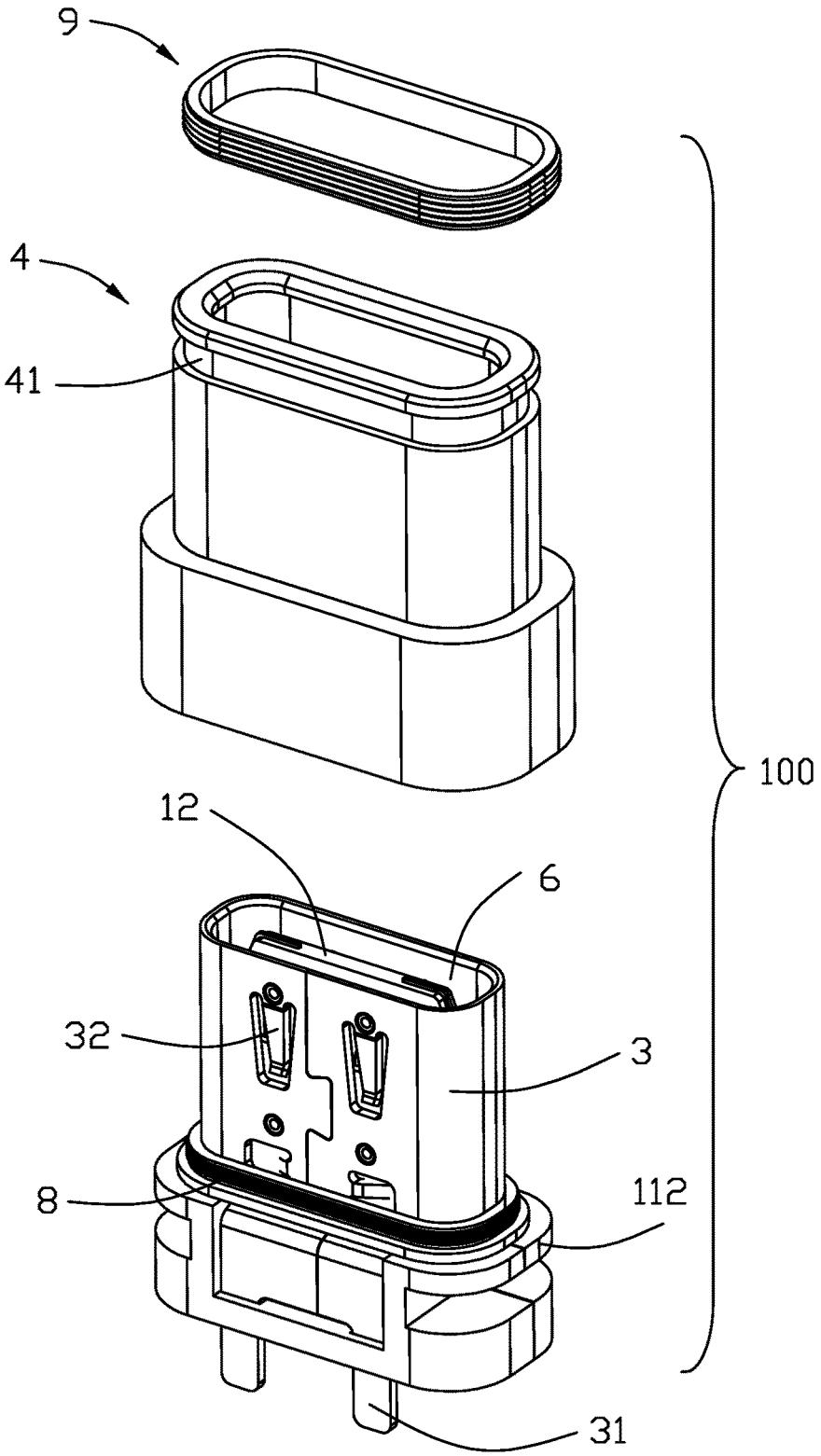
FIG. 3 is an exploded perspective view of the connector in FIG. 1.
Figure 4:
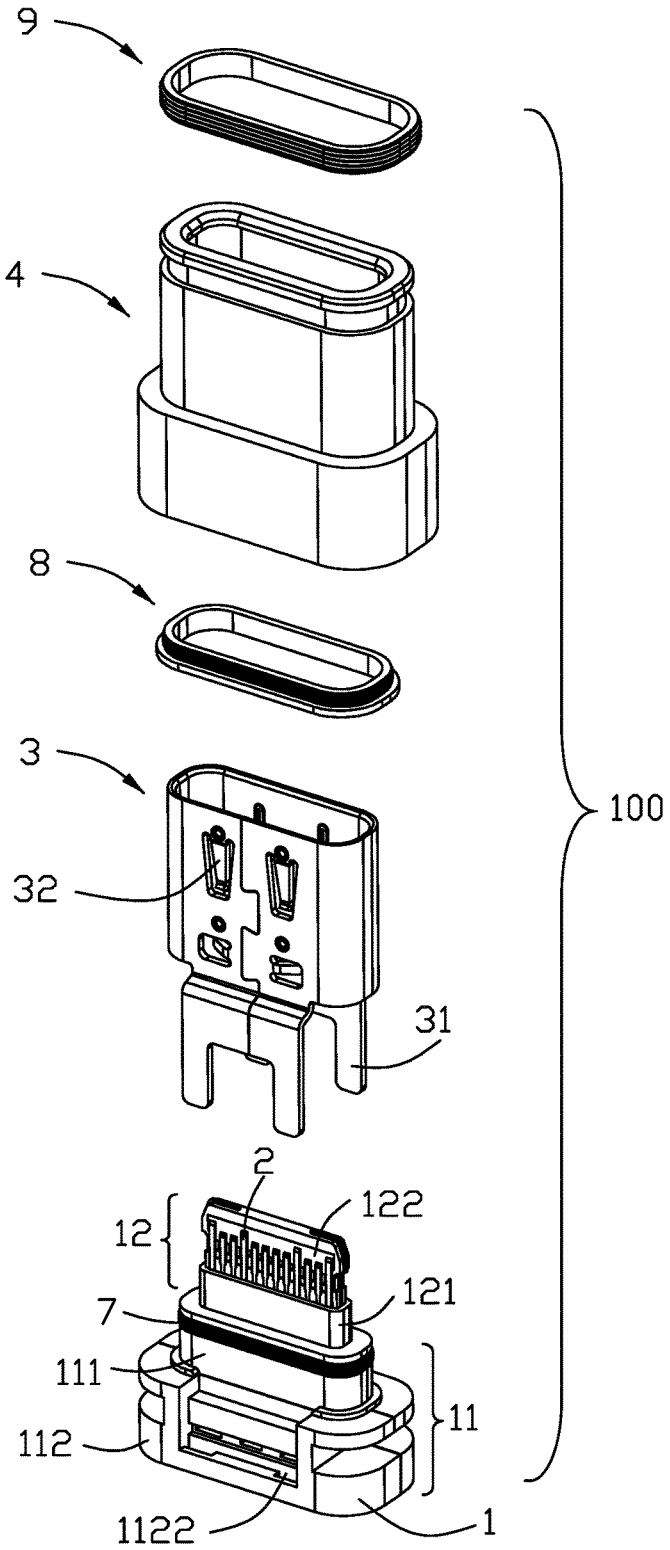
FIG. 4 is a further exploded perspective view of the connector in FIG. 3.
Figure 7:
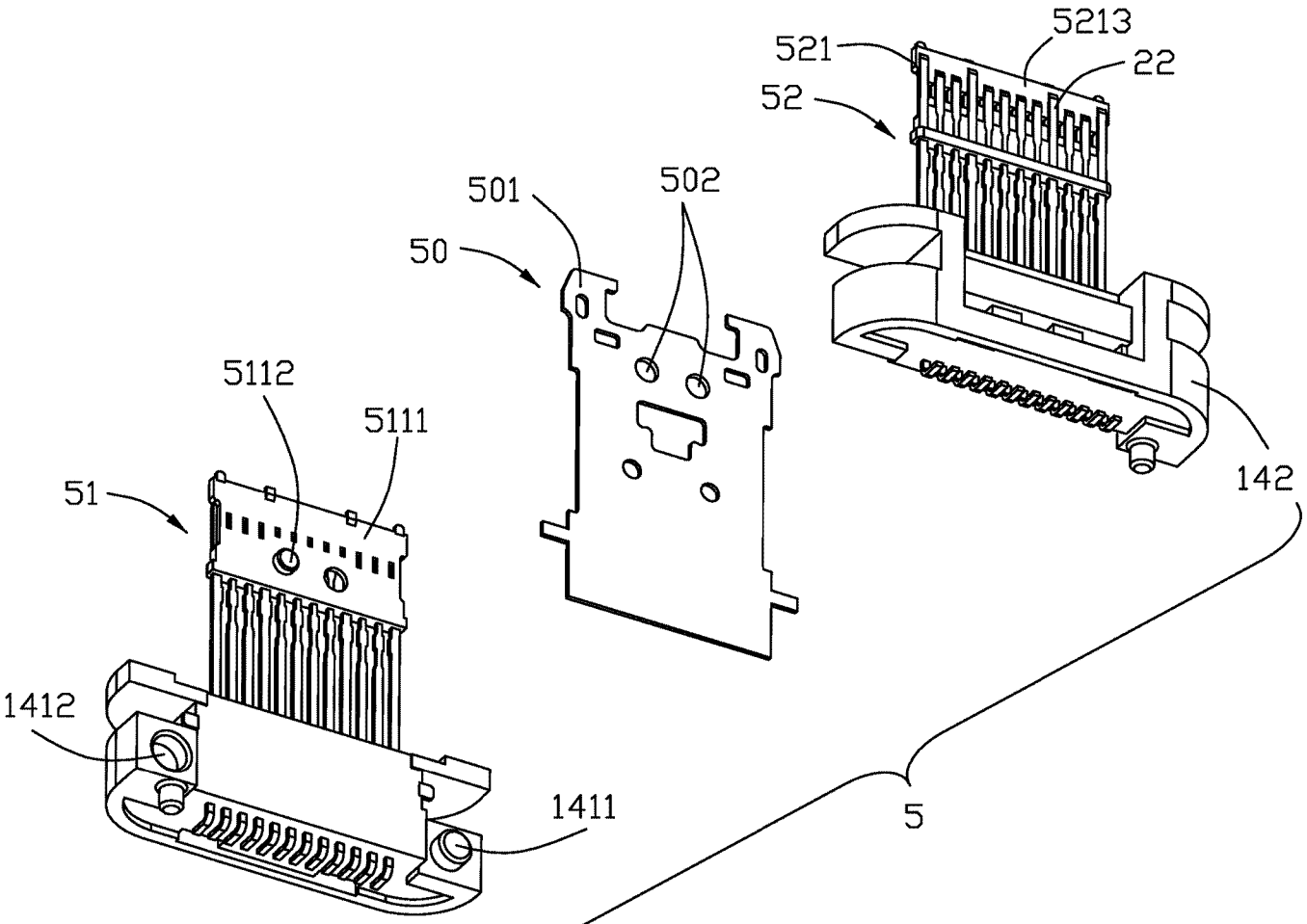
FIG. 7 is a further exploded perspective view of the insulative housing in FIG. 6.
Figure 8:
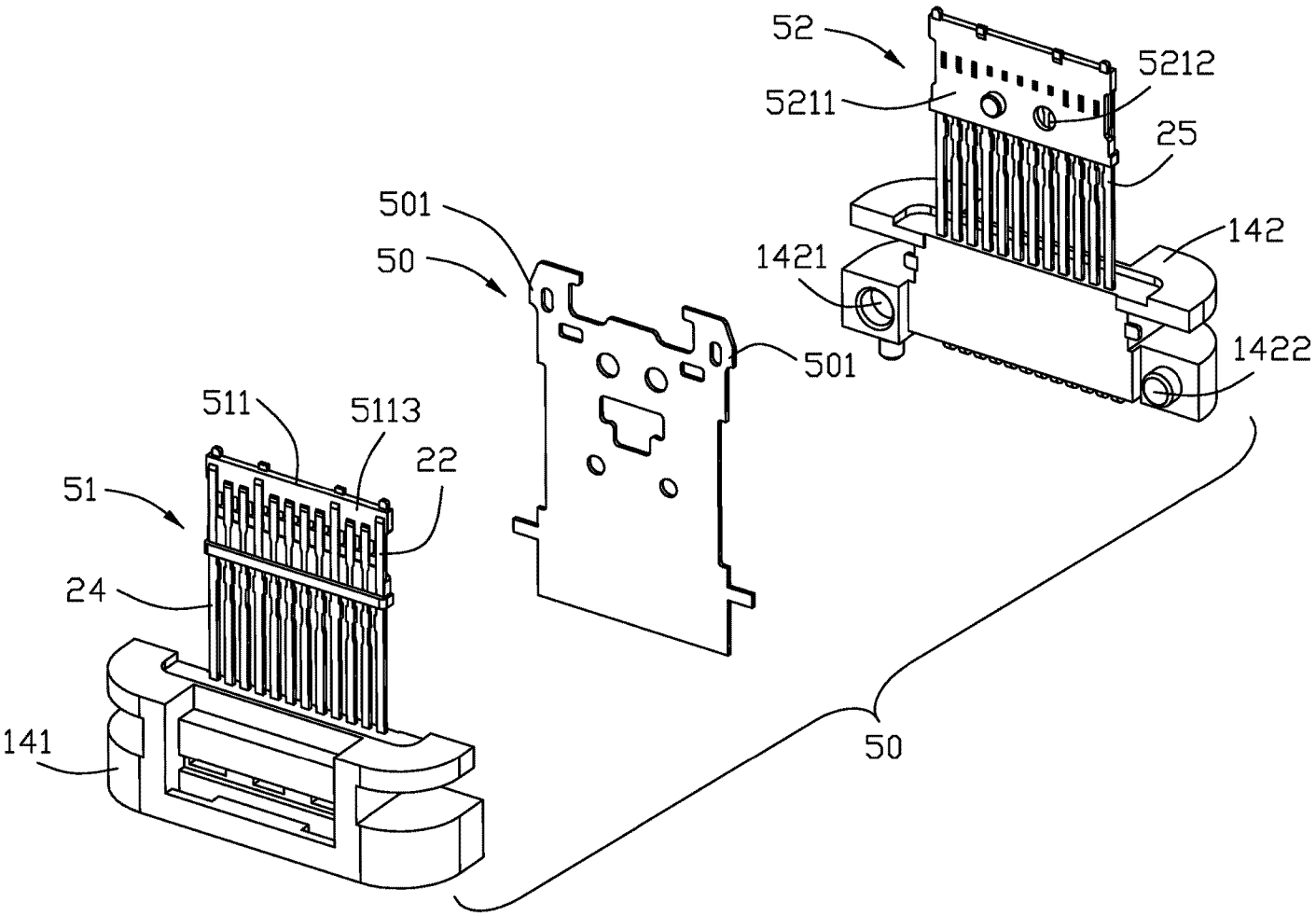
FIG. 8 is another exploded perspective view of the insulative housing in FIG. 7.
Figure 9:
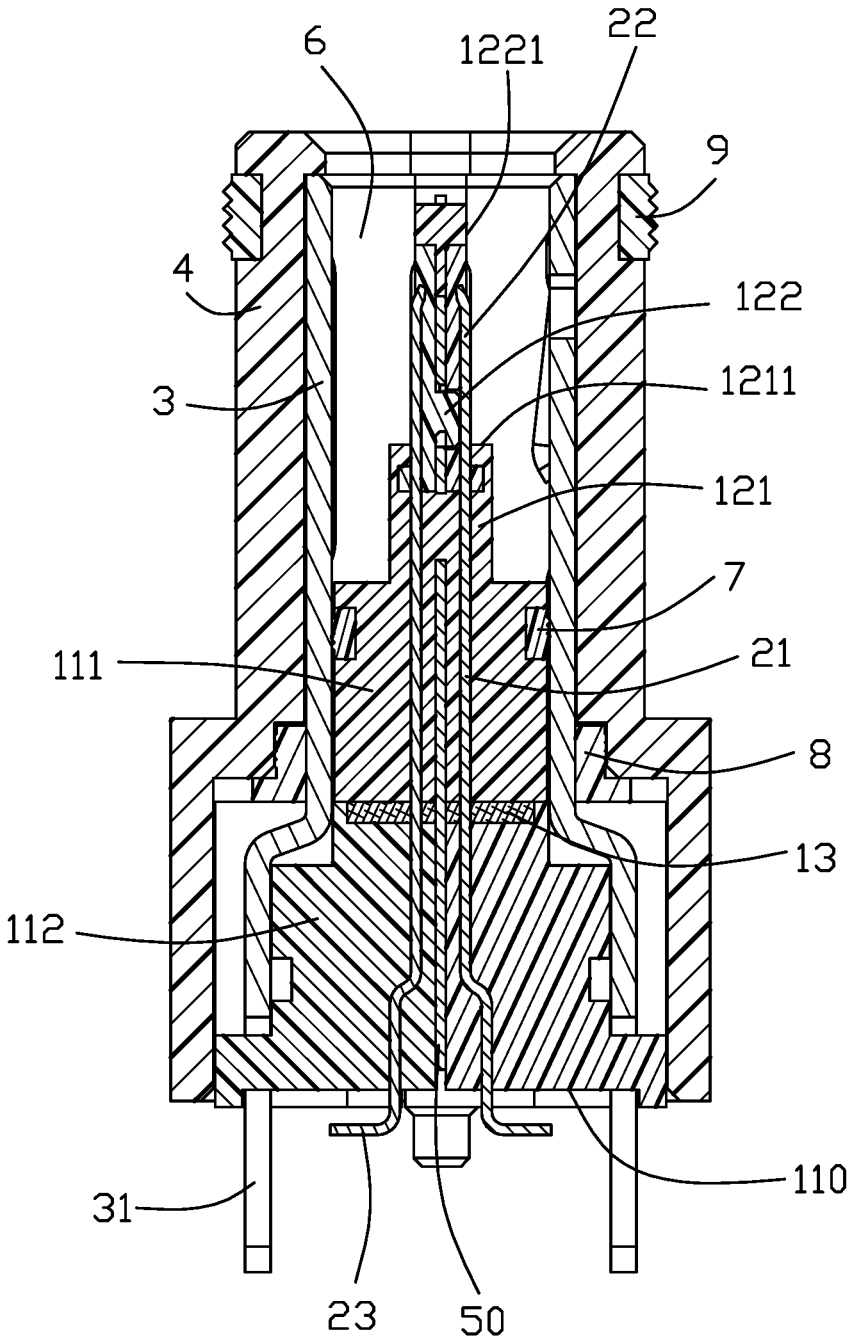
FIG. 9 is a cross-sectional view of the electrical connector taken along line 9-9 in FIG. 1.
Figure 10:
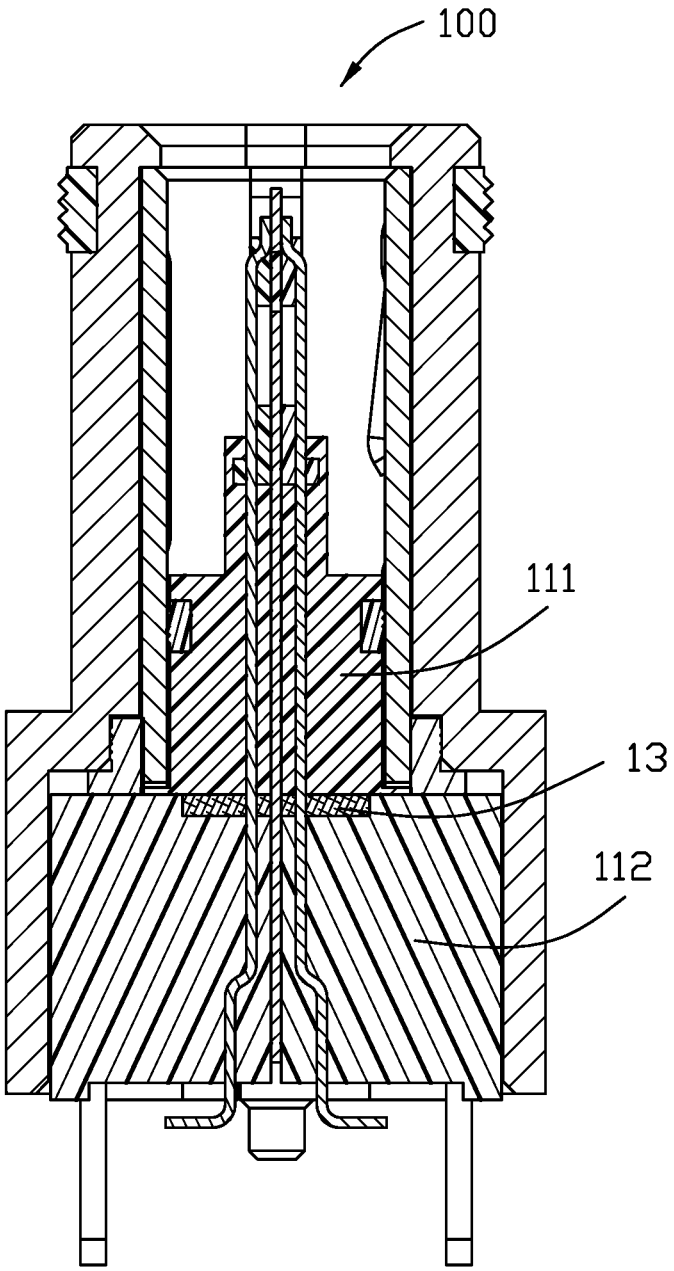
FIG. 10 is a cross-sectional view of the electrical connector taken along line 10-10 in FIG. 1.

Referring to FIGS. 1 to 10, a waterproof electrical connector 100 in accordance with the present invention comprises an insulative housing 1, a plurality of terminals 2 retained in the insulative housing 1, a metallic shell 3 and an insulating cover 4. As best shown in FIGS. 4, 9, 10, the insulative housing 1 standing in a vertical direction, has a base portion 11 and a mating tongue 12 and surrounded with the metallic shell 3 to define a mating cavity 6 with an opening through which a plug connector (not shown) is inserted in the mating cavity 6. The mating tongue 12 comprises a stepped portion 121 extending upward from the base portion 11 along an insertion direction of the connector and a tongue portion 122 further extending upwardly from the stepped portion 121. The stepped portion 121 defines a front face 1211 facing the opening of the cavity 6. The base portion 11 defines a rear face 110 opposite to the front face 1211 in the inserting direction. Each of the terminals 2 defines a connecting portion 21 buried in the base portion 11 and the stepped portion 121, a contacting portion 22 extending forward from the connecting portion 21 and a soldering tail 23 extending out of the base portion 11. The contacting portion 22 exposes upon two opposite surfaces 1221 of the tongue portion 122. A sealing member 13 is filling in insulative housing 1 and around the connecting portion 21. The sealing member 13 is disposed behind the front face 1211 of the stepped portion 121 and in front of the rear face 110 of the base portion 11 in the inserting direction and within the insulative housing 1 and do not slop over an outer periphery of insulative housing 1 connecting with the front and rear face 1211, 110.

Figure 5:
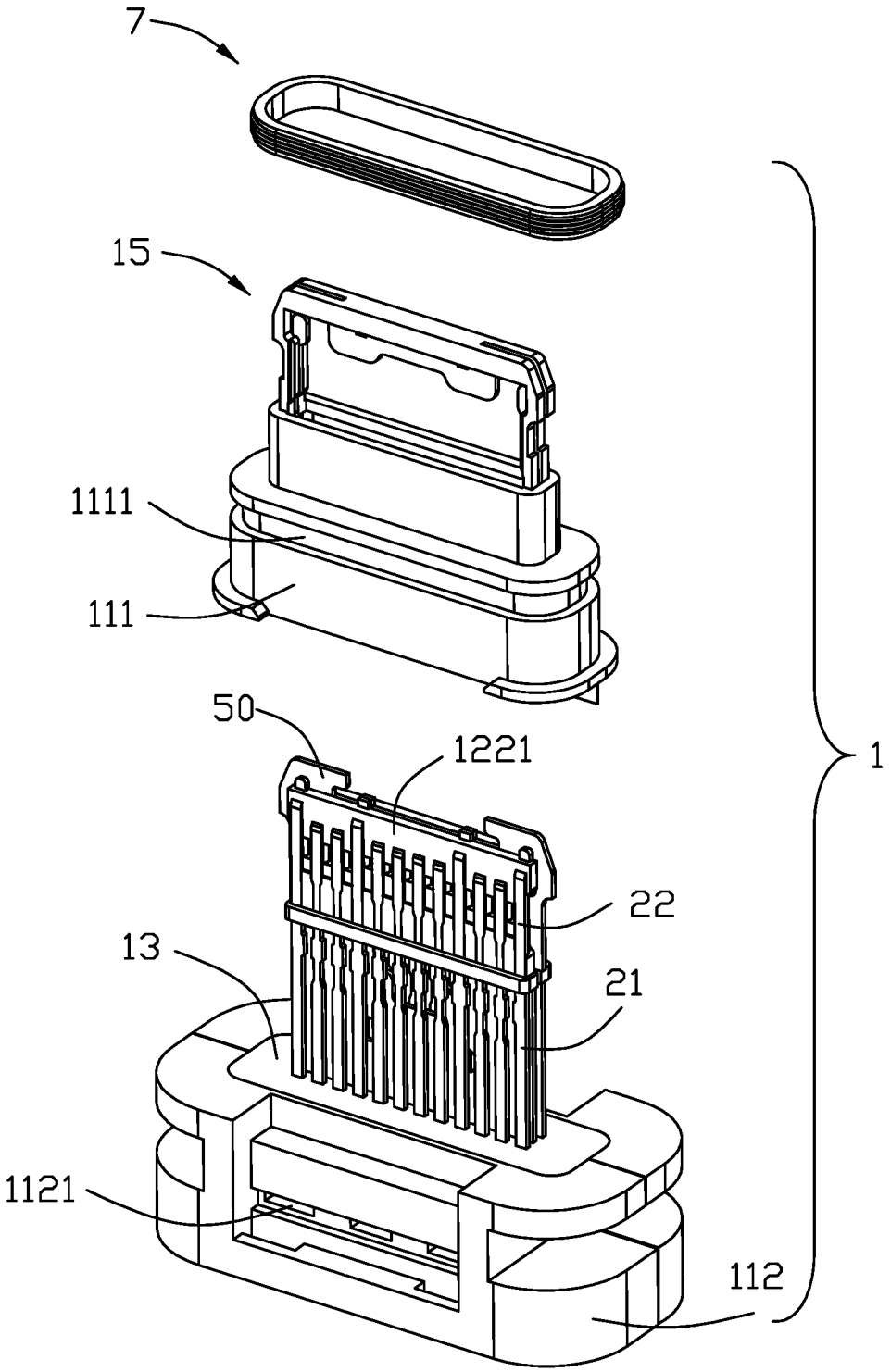
FIG. 5 is an exploded perspective view of the insulative housing in FIG. 4.
Figure 6:
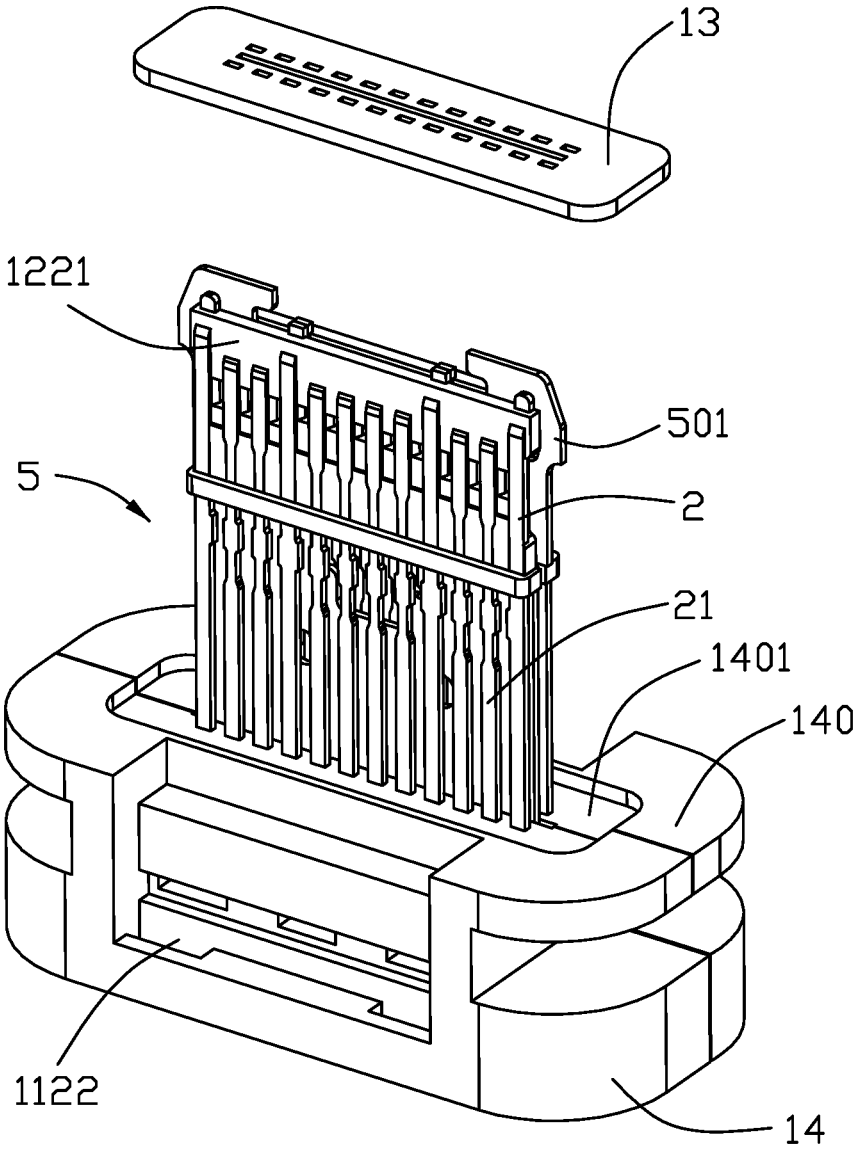
FIG. 6 is an exploded perspective view of the insulative housing in FIG. 5.

As shown in FIGS. 5 and 6, the sealing member 13 is a flat plate-like structure formed by solidification of glue. The electrical connector 100 comprises a terminal module assembly 5 and an injection molding body 15 over the terminals module 5. The terminal module assembly 5 comprises an insulative portion 14 with a front face 140 and the plurality of terminals 2 retained in the insulative portion 14. The insulative portion 14 defines a groove 1401 recessed from the front face 140. The upper portion of connecting portions 21 of the terminals 2 extend out the front face 140 of the insulative portion 14. The sealing member 13 is formed by solidification of glue injected into the groove 1401. The injection molding body 15 then is injected on the front face 140 of the insulative portion 14 to form the complete insulating housing 1. The injection molding body 15 encloses a part of the connecting portion 21 of the terminals 2 to form the stepped portion 121.

Referring to FIGS. 4 to 5, the base portion 11 comprises a first base portion 111 connecting the stepped portion 121 and a second base portion 112 located behind the first base portion 111. In preferred embodiment, the second base portion 112 is larger in size than the first base portion 111. The sealing member 13 is located at the second base portion 112.

Referring to FIGS. 3 to 4, the metallic shell 3 is fixed to the first base portion 111. The metal shell 3 surrounds the mating tongue 12 to form the mating cavity 6. As shown in FIGS. 3, 4 and 9, a first sealing ring 7 is disposed on the outer periphery of the first base portion 111. so that the first sealing ring 7 seals any gap between the first base portion 111 and the metallic shell 3. The first base portion 111 is provided with a sealing groove 1111. The first sealing ring 7 is arranged in the sealing groove 1111 to realize the waterproofing between the insulating housing 1 and the metal shell 3. The first sealing ring 7 also has the function of dust prevention. In this embodiment, the first sealing ring 7 is made of rubber material. The second base portion 112 has recesses 1121 extending through the outer surface thereof which is beneficial to prevent the warpage of the plastic when the second base portion 112 is formed.

As shown in FIGS. 1 to 9, the electrical connector 100 further comprises an insulating cover 4 injection molding on the outer periphery of the metallic shell 3 and on the outer side of the second base portion 112. A second sealing ring 8 is provided at the joint of the metallic shell 3 and the second base portion 112. The second sealing ring 8 is pressed between the metallic shell 3 and the insulating cover 4 which is further realizes the waterproof of the electric connector.

Referring to FIGS. 6 to 7, the terminal module assembly 5 comprises two sub-terminal modules 51, 52 and a shielding plate 50 sandwiched between the two sub-terminal modules. The shielding plate 50 is provided with a locking edge 501 which is exposed upon opposite sides of the tongue portion 122. The locking edge 501 is to be held with the plug connector to increase stability of the engagement of the connector and the plug connector. The two sub-terminal modules 51, 52 have a same structure. It is only necessary to use one set of molds to produce the first terminal module 51 and the second terminal module 52, which is advantageous for saving the cost of manufacturing.

As shown in FIGS. 7 to 8, the terminal 2 includes a plurality of first terminals 24 and a plurality of second terminals 25. The insulative portion 14 includes a first insulative portion 141 and a second insulative portion 142. The first terminals 24 are retained in the first insulative portion 141 to form the first terminal module 51. The second terminals 25 are retained in the second insulative portion 142 to form the second terminal module 52. The first terminal module 51 is assembled with the second terminal module 52, and the first insulative portion 141 and the second insulative portion 142 commonly form the complete insulative portion 14. The first terminal module 51 further includes a first fixing plate 511. The first terminal 24, the first fixing plate 511, and the first insulative portion 141 are integrally molded. The second terminal module 52 further includes a second fixing plate 521. The second terminal 25, the second fixing plate 521, and the second insulative portion 142 are integrally molded. The first fixing plate 511 defines a first mating surface 5113 facing to the mating cavity 6. The contacting portion 22 is protruded and exposed to the first mating surface 5113. The second fixing plate 521 defines a second mating surface 5213 facing to the mating cavity 6. The contacting portion 22 is protruded and exposed to the second mating surface 5213. The first and second mating surfaces 5113, 5213 are part of the surfaces 1221 of the tongue portion 122.

The first terminal module 51 defines a first mounting surface 5111, the second terminal module 52 defines a second mounting surface 5211 facing to the first mounting surface 5111. The first and second mounting surfaces 5111, 5211 define dowel pins and locating holes mating with the dowel pins to assemble the first and second terminal modules 51, 52 together. Specifically, the first terminal module 51 defines a first dowel pin 5112 protruding out of the first mounting surface 5111. The second mounting surface 5211 defines a second locating hole 5212 corresponding to the first dowel pin 5112. The shielding plate 50 defines a through hole 502. In this embodiment, the first dowel pin 5112 passes through the through hole 502 and is fixed to the second locating hole 5212. The first insulative portion 141 is provided with a first positioning block 1411 and a first positioning groove 1412, the second insulative portion 142 is provided with a second positioning groove 1421 and a second positioning block 1422. The first positioning block 1411 is fixed to the second positioning groove 1421; the second positioning block 1422 is fixed to the first positioning groove 1412. That makes the installation of the first and second terminal modules 51, 52 more stable.

Referring to FIGS. 2 to 5, the metallic (shielding) shell 3 includes four grounding portions or mounting legs 31 extending in the inserting direction. The insulating housing 1 comprises slits 1122 through which the grounding portions 31 go. The grounding portions 31 are fixed in the slits 1122 so that the metallic shell 3 is assembled on the insulating housing 1. The grounding portions 31 can be welded to an electronic equipment (not shown) and have a function of grounding and fixing. The metallic shell 3 comprises an elastic fingers 32 protruding into the mating cavity 6. The elastic fingers 32 may be elastically deformed along a thickness direction of the electrical connector 100 perpendicular to the inserting direction. The elastic fingers 32 abuts against the plug connector inserted in the mating cavity 6 to achieve a grounding function. At the same time, the elasticity of the elastic fingers 32 can also increase the stability of the engagement between the electrical connector 100 and the plug connector.

Figure 1:
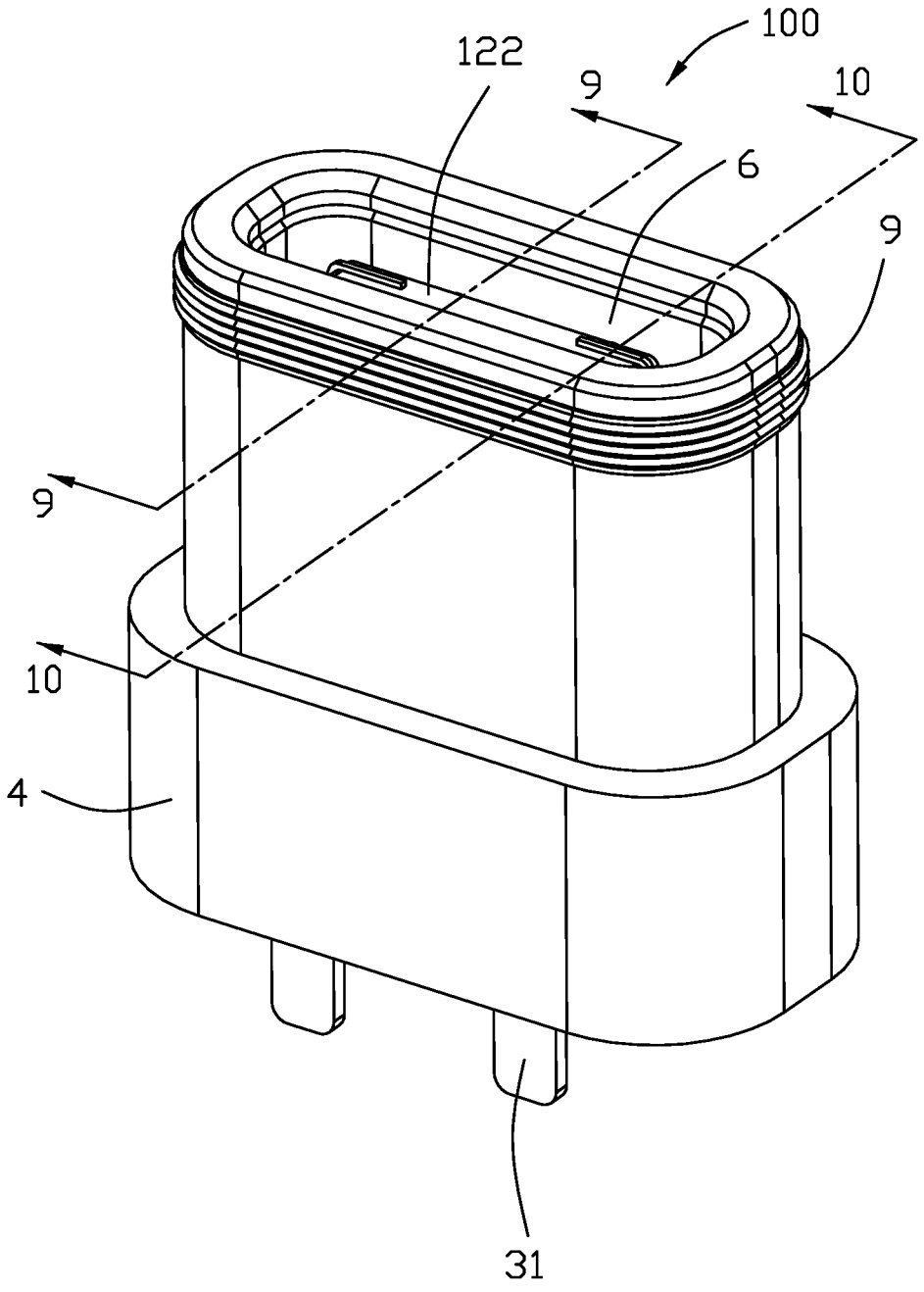
FIG. 1 is a perspective view of an electrical connector in accordance with the present invention.

As shown in FIGS. 1 to 3, electrical connector 100 further comprises a third sealing ring 9. The outer periphery of the insulating cover 4 defines a groove 41. The third sealing ring 9 is arranged in the groove 41. When the electrical connector 100 is mounted on the electronic equipment (not shown), the third sealing ring 9 is arranged at the joint to further realize the waterproof function. The third sealing ring 9 is made of rubber material. This allows the electrical connector 100 to be closely integrated with the electronic equipment (not shown) to prevent foreign matter from entering the equipment, such as water, dust, etc. In addition, the third sealing ring 9 can prevent the wobble of the electrical connector 100 when the electrical connector 100 mates with the mating connector (not shown).

Referring to FIGS. 9 to 10, the specific position of the sealing member 13 is mainly determined by the shape of the first terminal module 51 and the second terminal module 52. If the front face 140 of the first and second insulative portion 141, 142 extend forward to the position of the first base portion 111 or the stepped portion 121, the position of the sealing member 13 is also extend forward correspondingly. That is, the sealing member 13 may also be set in the first base portion 111 or the stepped portion 121. In short, the position of the sealing member 13 not extends out of the front face 1211 of the stepped portion 121, the rear face 110 of the base portion 11 and the out periphery of the insulative housing 1. Conclusively speaking, one feature of the invention is to provide the sealing member 13 protectively intimately enclosed between the insulative portion 14 of the terminal module assembly 5, i.e., the first insulative portion 141 of the first terminal modules 51 and the second insulative portion 142 of the second terminal module 52 both of which are made via a first stage insert-molding process, and the first base portion 111 of the injection molding body 15 which is made via a second stage insert-molding process. Differently, in the convention designs, the sealing member may be either exposed to an exterior or covered by the metallic shielding shell, not protectively and intimately hidden behind/under the insert-molded insulative body. Notably, in this embodiment the sealing member 13 is sandwiched between the insulative portion 14 and the injection molding body 15 in a vertical direction while the shielding plate 50 is sandwiched between the first terminal module 51 and the second terminal module 52 in a transverse direction perpendicular to the vertical direction, and the first terminals 24 and the second terminals 24 are arranged in two respective rows along the longitudinal direction perpendicular to both the vertical direction ant the transverse direction. Another feature of the invention is to have the metallic shell 3 attached upon the unified piece, i.e., the pre-assembled terminal module assembly 5 and injection molding body 15 after the second stage insert-molding process, and apply the insulative cover 4 thereupon in an overmolding process to secure the metallic shell 3 and the unified piece together.

However, the disclosure is illustrative only, changes may be made in detail, especially in matter of shape, size, and arrangement of sections within the principles of the invention.

What is claimed is:

1. A waterproof electrical connector comprising:

an insulative housing having a base portion and a mating tongue, the mating tongue comprising a stepped portion extending from the base portion and a tongue portion extending from the stepped portion in an inserting direction of the connector engaged with a mating connector, the stepped portion defining a front face, the base portion defining a rear face opposite to the front face in the inserting direction;

a plurality of terminals retained in the insulative housing comprising contacting portions exposed upon the tongue portion, connecting portions buried in the stepped portion and in the base portion and soldering tails extending out of the base portion; and a sealing member;

wherein the sealing member is filled around the connecting portions of the terminals, the sealing member is located behind the front face of the stepped portion and in front of the rear face of the base portion and is not sloped over an outer periphery of the insulative housing connecting with the front and rear faces, wherein the sealing member is a flat plate-like structure formed by solidification of glue, wherein the electrical connector comprises a terminal module assembly and an injection molding body molded on the terminal module assembly, the terminal module assembly comprises an insulative portion and the plurality of terminals retained in the insulative portion, the insulative portion defining a groove recessed from a front face thereof, the sealing member is formed by solidification of glue injected into the groove, the injection molding body is injected on the front face of the insulative portion to form the insulating housing, wherein the terminal module assembly comprises two sub-terminal modules and a shielding plate sandwiched between the two sub-terminal modules, wherein the injection molding body encloses a part of the connecting portions of the terminals to form the stepped portion, wherein the base portion comprises a first base portion connecting the stepped portion and a second base portion located behind the first base portion, the second base portion is larger in size than the first base portion, and the sealing member is located at the second base portion, wherein the electrical connector comprises a metallic shell fixed to the first base portion, the metal shell surrounds the mating tongue to define a mating cavity, the outer periphery of the first base portion is provided with a first sealing ring, the first sealing ring is pressed between the first base portion and the metallic shell, wherein the electrical connector further comprises an insulating cover injected molding on the outer periphery of the metallic shell and the outer periphery of the second base portion, and a second sealing ring is provided at a joint between the metallic shell and the second base portion, the second sealing ring is pressed between the metallic shell and the insulating cover.

2. The electrical connector as claimed in claim 1, wherein the shielding plate is provided with a locking edge which is exposed on opposite sides of the tongue portion.

3. The electrical connector as claimed in claim 1, wherein the two sub-terminal modules are a first terminal module and a second terminal module, and the first terminal module has a same structure as the second terminal module.

4. The electrical connector as claimed in claim 3, wherein the first terminal module defines a first mounting surface, the second terminal module defines a second mounting surface facing to the first mounting surface, the first terminal module defines a first dowel pin protruding out of the first mounting surface, the second mounting surface defines a second locating hole corresponding to the first dowel pin, the shielding plate defines a through hole, the first dowel pin passes through the through hole and is fixed to the second locating hole.

5. An electrical connector comprising:

a terminal module assembly including:

a plurality of terminals integrally formed with an insulative portion via a first insert-molding process, each of said terminals including a front contacting portion, a rear tail portion and a middle connecting portion linked between the front contacting portion and the rear tail portion;

a groove formed in the insulative portion, in which said connecting portions are exposed;

a sealing member filling the groove and enclosing said connecting portions; and an injection molding body applied upon said terminal module assembly to form a unified piece via a second insert-molding process to cover said groove so as to protectively have said sealing member embedded in said unified piece for reliable waterproof consideration, wherein the terminals include a first terminals and a second terminals, and the insulative portion includes a first insulative portion integrally formed with the first terminals to form a first terminal module, and the a second insulative portion integrally formed with the second terminals to form a second terminal module, and said terminal module assembly further includes a metallic shielding plate sandwiched between the first terminal module and the second terminal module in a first direction, wherein said sealing member is essentially sandwiched between the insulative portion and the injection molding body in a second direction perpendicular to said first direction, wherein the groove is circumferentially surrounded by the insulative portion along said second direction, further including a metallic shell enclosing the unified piece, and further including an insulating cover enclosing said metallic shell, wherein at least one sealing ring is positioned upon either an interior surface of the metallic shell to seal gaps between the metallic shell and the unified piece, or an exterior surface of the metallic shell to seal gaps between the metallic shell and the insulating cover.

6. The electrical connector as claimed in claim 5, wherein said sealing member is sandwiched between the insulative portion and the injection molding body in a vertical, and said insulative portion includes a slit to receive corresponding mounting legs of a metallic shielding shell which is assembled upon the unified piece in said direction.

7. The electrical connector as claimed in claim 6, further including an insulating cover overmolded upon the metallic shielding shell and the unified piece to secure the metallic shielding shell and the unified piece together.

* * * * *